US006324505B1

(12) United States Patent
Choy et al.

(10) Patent No.: US 6,324,505 B1
(45) Date of Patent: Nov. 27, 2001

(54) AMPLITUDE QUANTIZATION SCHEME FOR LOW-BIT-RATE SPEECH CODERS

(75) Inventors: Eddie Lun Tik Choy; Sharath Manjunath, both of San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/356,756

(22) Filed: Jul. 19, 1999

(51) Int. Cl.[7] ..... G10L 21/02; G10L 21/00

(52) U.S. Cl. ..... 704/230; 704/201

(58) Field of Search ..... 704/221, 211, 704/223, 222, 265, 205, 500, 501, 230, 224

(56) References Cited

U.S. PATENT DOCUMENTS

| | | | | |
|---|---|---|---|---|
| 5,414,796 | * | 5/1995 | Jacobs et al. | 704/221 |
| 5,517,595 | | 5/1996 | Kleijn | 395/2.14 |
| 5,581,653 | | 12/1996 | Todd . | |
| 5,884,253 | | 3/1999 | Kleijn | 704/223 |

FOREIGN PATENT DOCUMENTS 0666557 8/1995 (EP) .

OTHER PUBLICATIONS

1978 Digital Processing of Speech Signals, "Linear Predictive Coding of Speech", L.R. Rabiner et al., pp. 411–413.

1988 Proceedings of the Mobile Satellite Conference, "A 4.8 KBPS Code Excited Linear Predictive Coder", T. Tremain et al., pp. 491–496.

1991 Digital Signal Processing, "Methods of Waveform Interpolation in Speech Coding", W. Bastiaan Kleijn, et al., pp. 215–230.

1997 Proc. IEEE Int. Conf. On Acoustics Speech, Signal Processing, "Using A Perception–Based Frequency Scale in Waveform Interpolation", J. Thyssen et al., pp. 1595–1598.

K. Yaghmaie, et al, Multiband Prototype Waveform Analysis Synthesis for Very Low Bit Rate Speech Coding, IEEE International Conference on Acoustics, Speech, and Signal Processing, (ICASSP), US, Los Alamitos, IEEE Comp. Soc. Press. Apr. 21, 1997, pp. 1571–1574.

P.C. Meuse, "A 2400 BPS Multi–Band Excitation Vocoder," International Conference on Acoustics, Speech & Signal Processing, ICASSP, US, New York, IEEE vol. Conf. 15.3 Apr. 1990, pp. 9–12.

* cited by examiner

*Primary Examiner*—Richemond Dorvil
*Assistant Examiner*—Daniel A. Nolan
(74) *Attorney, Agent, or Firm*—Philip Wadsworth; Thomas R. Rouse; Kent D. Baker

(57) ABSTRACT

An amplitude quantization scheme for low-bit-rate speech coders includes the first step of extracting a vector of spectral information from a frame. The energy of the vector is normalized to generate gain factors. The gain factors are differentially vector quantized. The normalized gain factors are non-uniformly downsampled to generate a fixed-dimension vector with elements associated with a set of non-uniform frequency bands. The fixed-dimension vector is split into two or more sub-vectors. The sub-vectors are differentially quantized, to best advantage with a harmonic cloning process.

45 Claims, 10 Drawing Sheets

AMPLITUDE QUANTIZATION SCHEME FOR LOW-BIT-RATE SPEECH CODERS

BACKGROUND OF THE INVENTION

I. Field of the Invention

The present invention pertains generally to the field of speech processing, and more specifically to parameter quantization in speech coders.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices for compressing speech find use in many fields of telecommunications. An exemplary field is wireless communications. The field of wireless communications has many applications including, e.g., cordless telephones, paging, wireless local loops, wireless telephony such as cellular and PCS telephone systems, mobile Internet Protocol (JP) telephony, and satellite communication systems. A particularly important application is wireless telephony for mobile subscribers.

Various over-the-air interfaces have been developed for wireless communication systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, IS-95B, proposed third generation standards IS-95C and IS-2000, etc. (referred to collectively herein as IS-95), are promulgated by the Telecommunication Industry Association (TIA) and other well known standards bodies to specify the use of a CDMA over-the-air interface for cellular or PCS telephony communication systems. Exemplary wireless communication systems configured substantially in accordance with the use of the IS-95 standard are described in U.S. Pat. Nos. 5,103,459 and 4,901,307, which are assigned to the assignee of the present invention and fully incorporated herein by reference.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Perhaps most important in the design of a speech coder is the search for a good set of parameters (including vectors) to describe the speech signal. A good set of parameters requires a low system bandwidth for the reconstruction of a perceptually accurate speech signal. Pitch, signal power, spectral envelope (or formants), amplitude spectra, and phase spectra are examples of the speech coding parameters.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R.M. Gray, Vector Quantization and Signal Conmpression (1992).

A well-known time-domain speech coder is the Code Excited Linear Predictive (CELP) coder described in L.B. Rabiner & R.W. Schafer, Digital Processing of Speech Signals 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, No, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the present invention and fully incorporated herein by reference.

Time-domain coders such as the CELP coder typically rely upon a high number of bits, $N_o$, per frame to preserve the accuracy of the time-domain speech waveform. Such coders typically deliver excellent voice quality provided the number of bits, $N_o$, per frame relatively large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications. Hence, despite improvements over time, many CELP coding systems operating at low bit rates suffer from perceptually significant distortion typically characterized as noise.

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

One effective technique to encode speech efficiently at low bit rates is multimode coding. An exemplary multimode coding technique is described in U.S. application Ser. No. 09/217,341, entitled VARIABLE RATE SPEECH CODING, filed Dec. 21, 1998, assigned to the assignee of the present invention, and fully incorporated herein by reference. Conventional multimode coders apply different modes, or encoding-decoding algorithms, to different types of input speech frames. Each mode, or encoding-decoding process, is customized to optimally represent a certain type of speech segment, such as, e.g., voiced speech, unvoiced speech, transition speech (e.g., between voiced and unvoiced), and background noise (nonspeech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, typically characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or on the speech signal. An exemplary PWI, or PPP, speech coder is described in U.S. application Ser. No. 09/217,494, entitled PERIODIC SPEECH CODING, filed Dec. 21, 1998, assigned to the assignee of the present invention, and fully incorporated herein by reference. Other PWI, or PPP, speech coders are described in U.S. Pat. No. 5,884,253 and W. Bastiaan Kleijn & Wolfgang Granzow Methods for Waveform Interpolation in Speech Coding, in 1 Digital Signal Processing 215–230 (1991).

It is well known that spectral information embedded in speech is of great perceptual importance, particularly in voiced speech. Many state-of-the-art speech coders such as the prototype waveform interpolation (PWI) coder or prototype pitch period (PPP) coder, multiband excitation (MBE) coder, and the sinusoidal transform coder (STC) use spectral magnitude as an explicit encoding parameter. However, efficient encoding of such spectral information has been a challenging task. This is mainly because the spectral vector, commonly represented by a set of harmonic amplitudes, has a dimension proportional to the estimated pitch period. As the pitch varies from frame to frame, the dimension of the amplitude vector varies as well. Hence, a VQ method that handles variable-dimension input vectors is required to encode a spectral vector. Nevertheless, an effective variable-dimension VQ method (with less consumption of bits and memory) does not yet exist.

As is known to those skilled in the art, the frequency resolution of human ears is a nonlinear function of frequency (e.g., mel-scale and bark-scale) and human ears are less sensitive to spectral details at higher frequencies than at lower frequencies. It is desirable that such knowledge regarding human perception be fully exploited when designing an efficient amplitude quantizer.

In conventional low-bit-rate speech coders, the amplitude and phase parameters may be individually quantized and transmitted for each prototype of each frame. As an alternative, the parameters may be directly vector quantized in order to reduce the number of bits needed to represent the parameters. However, it is desirable to further reduce the requisite number of bits for quantizing the frame parameters. It would be advantageous, therefore, to provide an efficient quantization scheme to perceptually represent the amplitude spectra of a speech signal or a linear prediction residual signal. Thus, there is a need for a speech coder that efficiently quantizes amplitude spectra with a low-rate bit stream to enhance channel capacity.

SUMMARY OF THE INVENTION

The present invention is directed to a speech coder that efficiently quantizes amplitude spectra with a low-rate bit stream to enhance channel capacity. Accordingly, in one aspect of the invention, a method of quantizing spectral information in a speech coder advantageously includes the steps of extracting a vector of spectral information from a frame, the vector having a vector energy value; normalizing the vector energy value to generate a plurality of gain factors; differentially vector quantizing the plurality of gain factors; non-uniformly downsampling the plurality of normalized gain factors to generate a fixed-dimension vector having a plurality of elements associated with a respective plurality of non-uniform frequency bands; splitting the fixed-dimension vector into a plurality of sub-vectors; and differentially quantizing the plurality of sub-vectors.

In another aspect of the invention, a speech coder advantageously includes means for extracting a vector of spectral information from a frame, the vector having a vector energy value; means for normalizing the vector energy value to generate a plurality of gain factors; means for differentially vector quantizing the plurality of gain factors; means for non-uniformly downsampling the plurality of normalized gain factors to generate a fixed-dimension vector having a plurality of elements associated with a respective plurality of non-uniform frequency bands; means for splitting the fixed-dimension vector into a plurality of sub-vectors; and means for differentially quantizing the plurality of sub-vectors.

In another aspect of the invention, a speech coder advantageously includes an extraction module configured to extract a vector of spectral information from a frame, the vector having a vector energy value; a normalization module coupled to the extraction module and configured to normalize the vector energy value to generate a plurality of gain factors; a differential vector quantization module coupled to the normalization module and configured to differentially vector quantize the plurality of gain factors; a downsampler coupled to the normalization module and configured to non-uniformly downsample the plurality of normalized gain factors to generate a fixed-dimension vector having a plurality of elements associated with a respective plurality of non-uniform frequency bands; a splitting mechanism for splitting the fixed-dimension vector into a high-band sub-vector and a low-band sub-vector; and a differential quantization module coupled to the splitting mechanism and configured to differentially quantize the high-band sub-vector and the low-band sub-vector.

DETAILED DESCRIPTION OF THE PREFERRED EMBODIMENTS

The exemplary embodiments described hereinbelow reside in a wireless telephony communication system configured to employ a CDMA over-the-air interface. Nevertheless, it would be understood by those skilled in the art that a subsampling method and apparatus embodying features of the instant invention may reside in any of various communication systems employing a wide range of technologies known to those of skill in the art.

Figure 1:
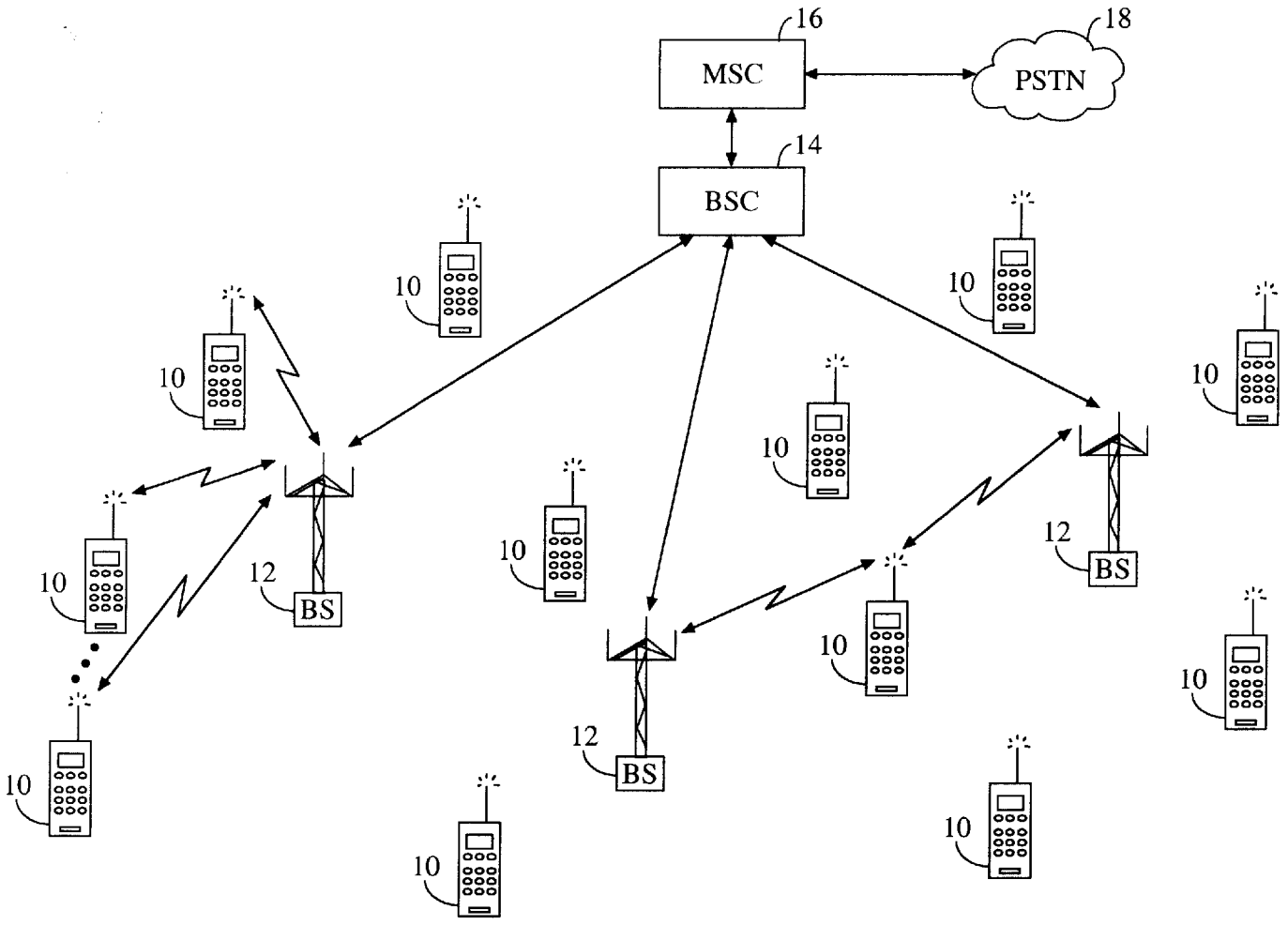
FIG. 1 PRIOR ART
FIG. 1 is a block diagram of a wireless telephone system.

As illustrated in FIG. 1, a CDMA wireless telephone system generally includes a plurality of mobile subscriber units 10, a plurality of base stations 12, base station controllers (BSCs) 14, and a mobile switching center (MSC) 16.The MSC 16 is configured to interface with a conventional public switch telephone network (PSTN) 18.The MSC 16 is also configured to interface with the BSCs 14. The BSCs 14 are coupled to the base stations 12 via backhaul lines. The backhaul lines may be configured to support any of several known interfaces including, e.g., El/Ti, ATM, IP, PPP, Frame Relay, HDSL, ADSL, or xDSL. It is understood that there may be more than two BSCs 14 in the system. Each base station 12 advantageously includes at least one sector (not shown), each sector comprising an omnidirectional antenna or an antenna pointed in a particular direction radially away from the base station 12. Alternatively, each sector may comprise two antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The mobile subscriber units 10 are typically cellular or PCS telephones 10. The system is advantageously configured for use in accordance with the IS-95 standard.

During typical operation of the cellular telephone system, the base stations 12 receive sets of reverse link signals from sets of mobile units 10. The mobile units 10 are conducting telephone calls or other communications. Each reverse link signal received by a given base station 12 is processed within that base station 12. The resulting data is forwarded to the BSCs 14. The BSCs 14 provides call resource allocation and mobility management functionality including the orchestration of soft handoffs between base stations 2. The BSCs 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile units 10.

Figure 2:
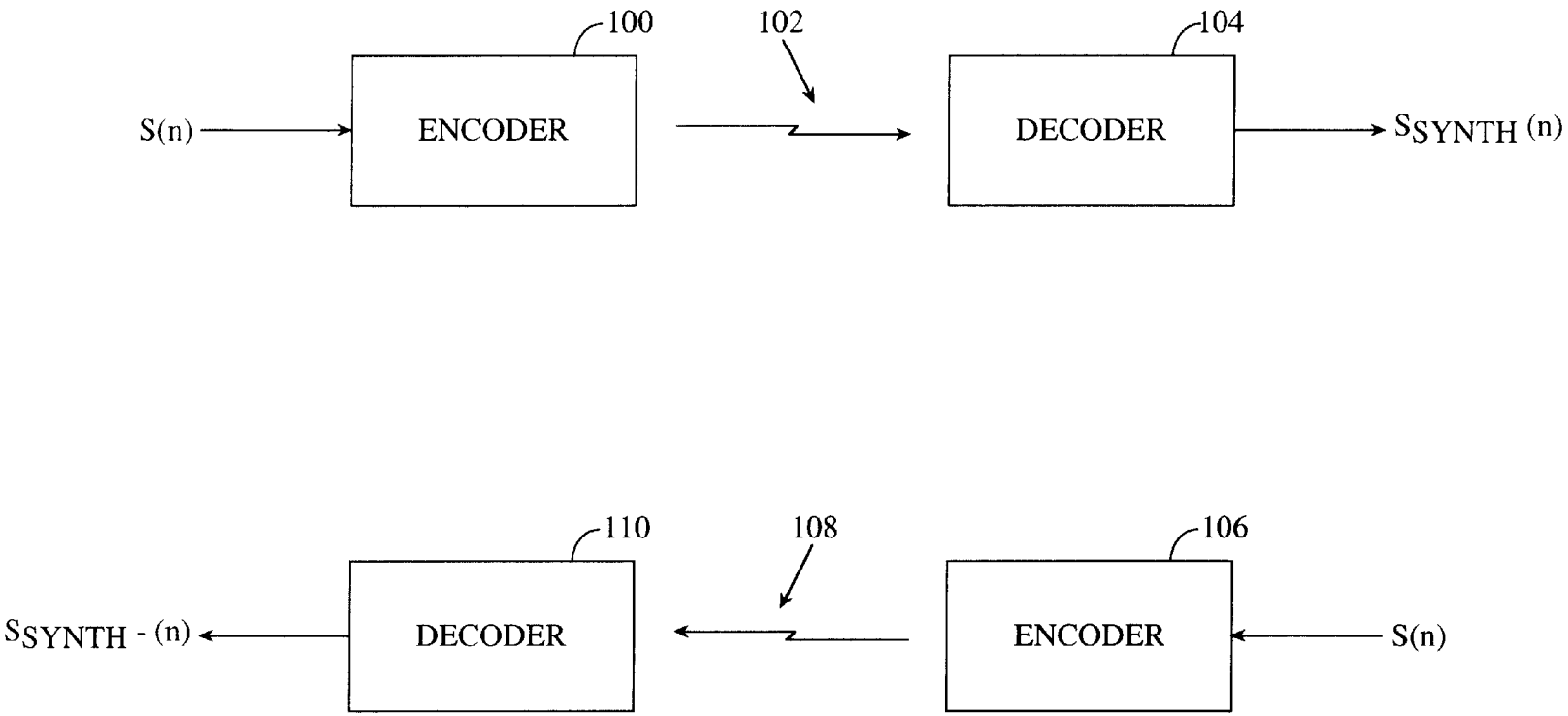
FIG. 2 PRIOR ART
FIG. 2 is a block diagram of a communication channel terminated at each end by speech coders.

In FIG. 2 a first encoder 100 receives digitized speech samples s(n) and encodes the samples s(n) for transmission on a transmission medium 102, or communication channel 102, to a first decoder 104. The decoder 104 decodes the encoded speech samples and synthesizes an output speech signal $S_{SYNTH}(n)$. For transmission in the opposite direction, a second encoder 106 encodes digitized speech samples s(n), which are transmitted on a communication channel 108. A second decoder 110 receives and decodes the encoded speech samples, generating a synthesized output speech signal $S_{SYNTH}(n)$.

The speech samples s(n) represent speech signals that have been digitized and quantized in accordance with any of various methods known in the art including, e.g., pulse code modulation (PCM), companded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-to-frame basis from 13.2 kbps (full rate) to 6.2 kbps (half rate) to 2.6 kbps (quarter rate) to 1 kbps (eighth rate). Varying the data transmission rate is advantageous because lower bit rates may be selectively employed for frames containing relatively less speech information. As understood by those skilled in the art, other sampling rates, frame sizes, and data transmission rates may be used.

The first encoder 100 and the second decoder 110 together comprise a first speech coder, or speech codec. The speech coder could be used in any communication device for transmitting speech signals, including, e.g., the subscriber units, BTSs, or BSCs described above with reference to FIG. 1. Similarly, the second encoder 106 and the first decoder 104 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. Pat. No. 5,784,532, entitled VOCODER ASIC, filed Feb. 16, 1994, assigned to the assignee of the present invention, and fully incorporated herein by reference.

Figure 3:
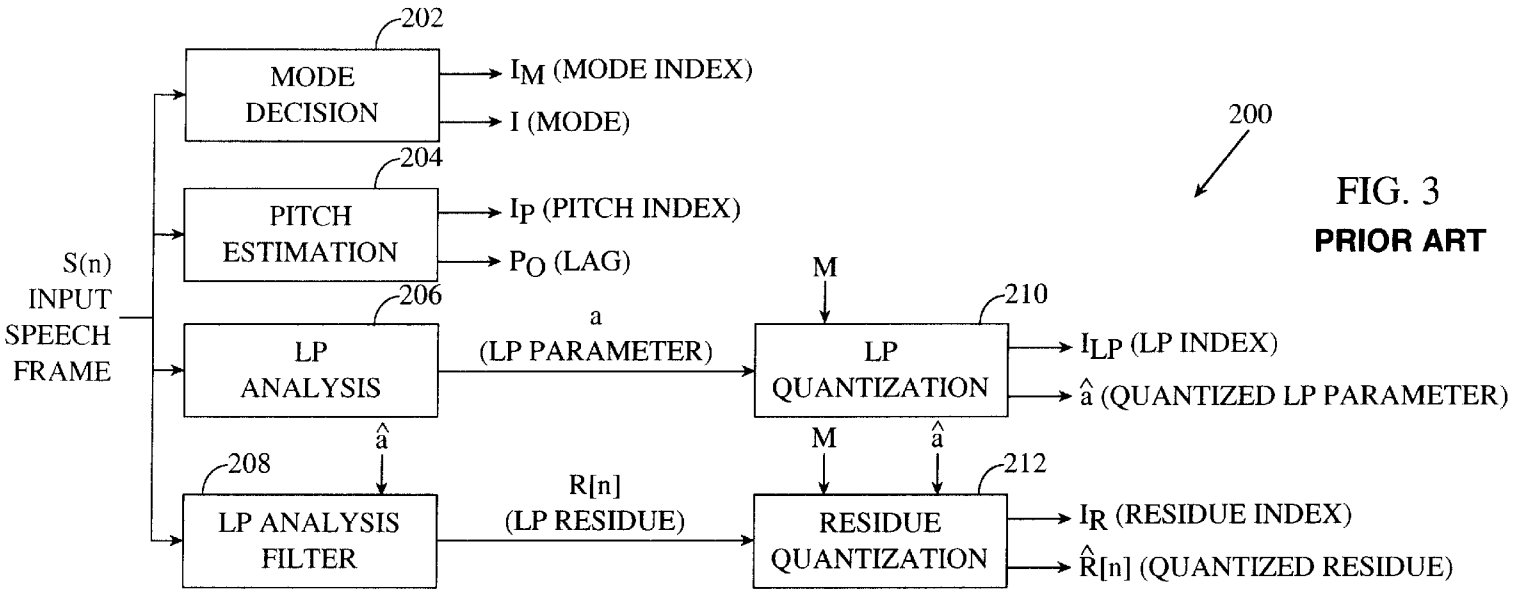
FIG. 3 PRIOR ART
FIG. 3 is a block diagram of an encoder.

In FIG. 3 an encoder 200 that may be used in a speech coder includes a mode decision module 202, a pitch estimation module 204, an LP analysis module 206, an LP analysis filter 208, an LP quantization module 210, and a residue quantization module 212. Input speech frames s(n) are provided to the mode decision module 202, the pitch estimation module 204, the LP analysis module 206, and the LP analysis filter 208. The mode decision module 202 produces a mode index $I_M$ and a mode M based upon the periodicity, energy, signal-to-noise ratio (SNR), or zero crossing rate, among other features, of each input speech frame s(n). Various methods of classifying speech frames according to periodicity are described in U.S. Pat. No. 5,911,128, which is assigned to the assignee of the present invention and fully incorporated herein by reference. Such methods are also incorporated into the Telecommunication Industry Association Industry Interim Standards TIA/EIA IS-127 and TIA/EIA IS-733. An exemplary mode decision scheme is also described in the aforementioned U.S. application Ser. No. 09/217,341.

Figure 4:
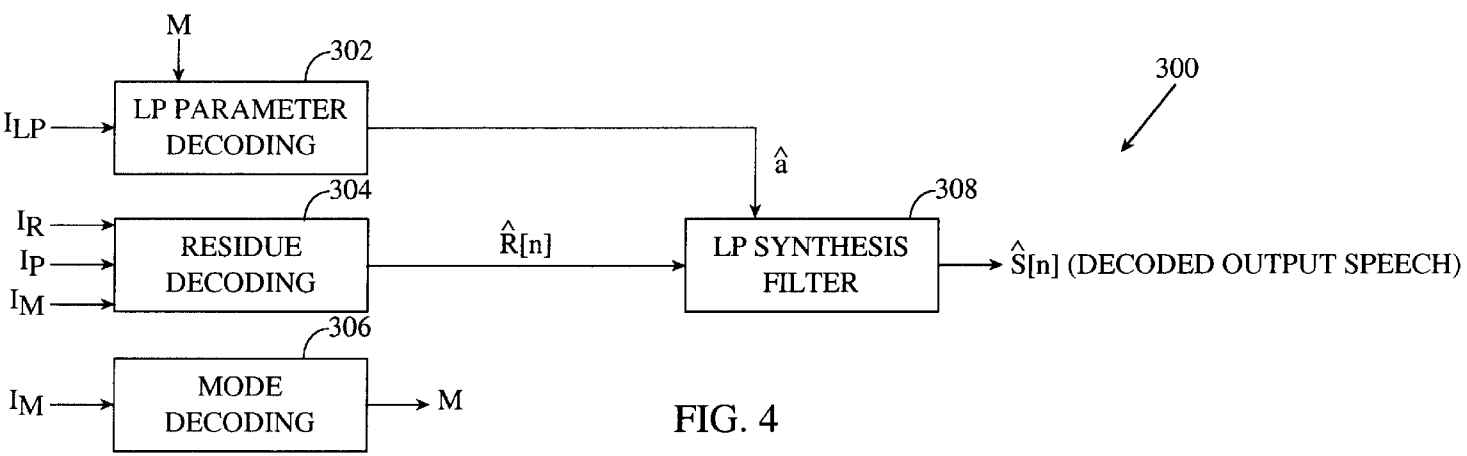
FIG. 4 PRIOR ART
FIG. 4 is a block diagram of a decoder.

The pitch estimation module 204 produces a pitch index $I_P$ and a lag value $P_O$ based upon each input speech frame s(n). The LP analysis module 206 performs linear predictive analysis on each input speech frame s(n) to generate an LP parameter a. The LP parameter a is provided to the LP quantization module 210. The LP quantization module 210 also receives the mode M, thereby performing the quantization process in a mode-dependent manner. The LP quantization module 210 produces an LP index $I_{LP}$ and a quantized LP parameter â. The LP analysis filter 208 receives the quantized LP parameter â in addition to the input speech frame s(n). The LP analysis filter 208 generates an LP residue signal R[n], which represents the error between the input speech frames s(n) and the reconstructed speech based on the quantized linear predicted parameters â. The LP residue R[n], the mode M, and the quantized LP parameter â are provided to the residue quantization module 212. Based upon these values, the residue quantization module 212 produces a residue index $I_R$ and a quantized residue signal R̂[n]. In FIG. 4 a decoder 300 that may be used in a speech coder includes an LP parameter decoding module 302, a residue decoding module 304, a mode decoding module 306, and an LP synthesis filter 308. The mode decoding module 306 receives and decodes a mode index $I_M$/generating therefrom a mode M. The LP parameter decoding module 302 receives the mode M and an LP index $I_{LP}$. The LP parameter decoding module 302 decodes the received values to produce a quantized LP parameter â. The residue decoding module 304 receives a residue index $I_R$, a pitch index $I_P$, and the mode index $I_M$. The residue decoding module 304 decodes the received values to generate a quantized residue signal R̂[n]. The quantized residue signal R̂[n] and the quantized LP parameter â are provided to the LP synthesis filter 308, which synthesizes a decoded output speech signal ŝ[n] therefrom.

Operation and implementation of the various modules of the encoder 200 of FIG. 3 and the decoder 300 of FIG. 4 are known in the art and described in the aforementioned U.S. Pat. No. 5,414,796 and L. B. Rabiner & R. W. Schafer, Digital Processing of Speech Signals 396–453 (1978).

Figure 5:
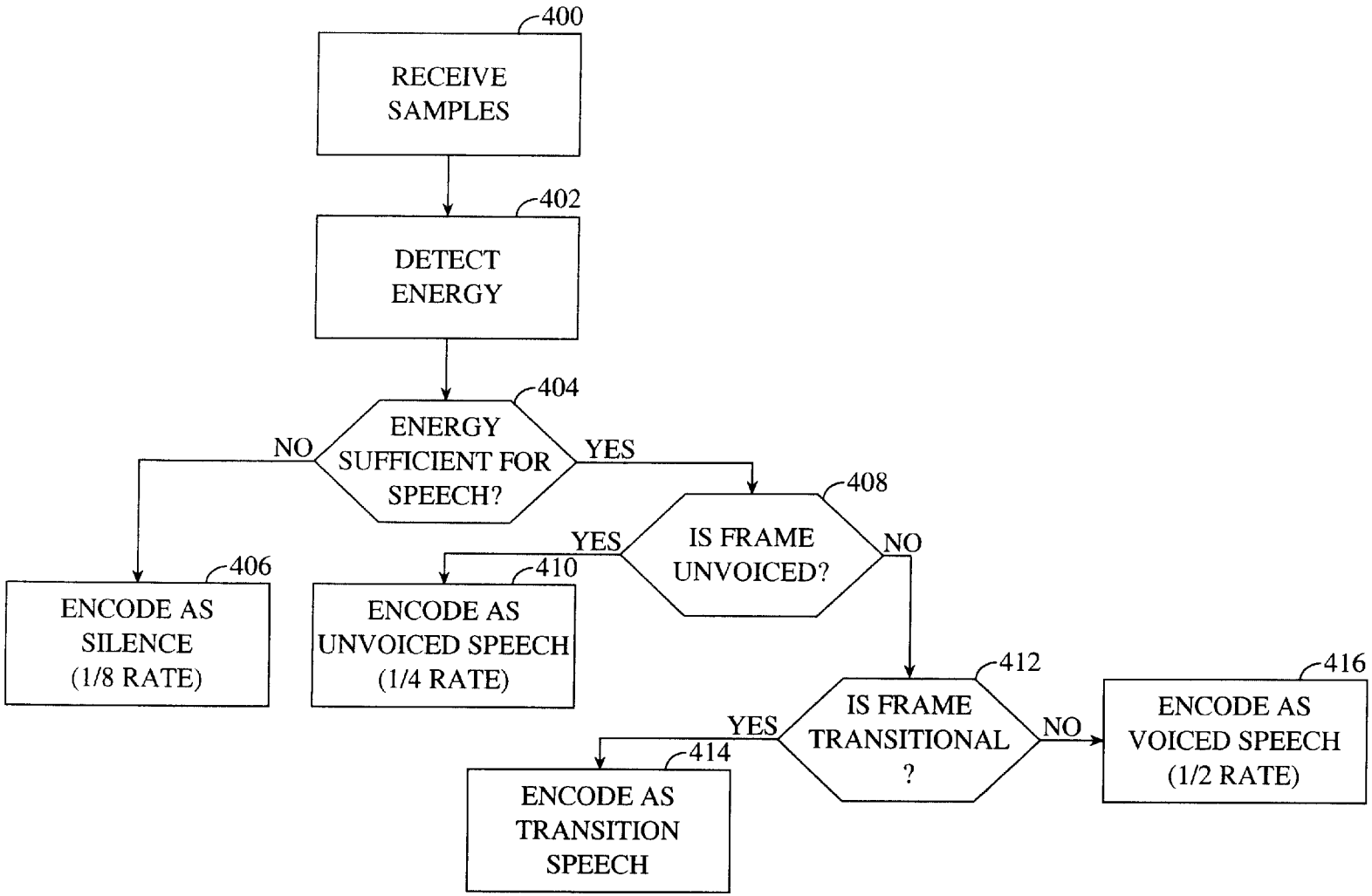
FIG. 5 is a flow chart illustrating a speech coding decision process.

As illustrated in the flow chart of FIG. 5, a speech coder in accordance with one embodiment follows a set of steps in processing speech samples for transmission. In step 400 the speech coder receives digital samples of a speech signal in successive frames. Upon receiving a given frame, the speech coder proceeds to step 402. In step 402 the speech coder detects the energy of the frame. The energy is a measure of the speech activity of the frame. Speech detection is performed by summing the squares of the amplitudes of the digitized speech samples and comparing the resultant energy against a threshold value. In one embodiment the threshold value adapts based on the changing level of background noise. An exemplary variable threshold speech activity detector is described in the aforementioned U.S. Pat. No. 5,414,796. Some unvoiced speech sounds can be extremely low-energy samples that may be mistakenly encoded as background noise. To prevent this from occurring, the spectral tilt of low-energy samples may be used to distinguish the unvoiced speech from background noise, as described in the aforementioned U.S. Pat. No. 5,414,796.

After detecting the energy of the frame, the speech coder proceeds to step 404. In step 404 the speech coder determines whether the detected frame energy is sufficient to classify the frame as containing speech information. If the detected frame energy falls below a predefined threshold level, the speech coder proceeds to step 406. In step 406 the speech coder encodes the frame as background noise (i.e., nonspeech, or silence). In one embodiment the background noise frame is encoded at ⅛ rate, or 1 kbps. If in step 404 the detected frame energy meets or exceeds the predefined threshold level, the frame is classified as speech and the speech coder proceeds to step 408.

In step 408 the speech coder determines whether the frame is unvoiced speech, i.e., the speech coder examines the periodicity of the frame. Various known methods of periodicity determination include, e.g., the use of zero crossings and the use of normalized autocorrelation functions (NACFs). In particular, using zero crossings and NACFs to detect periodicity is described in the aforementioned U.S. Pat. No. 5,911,128 and U.S. application Ser. No. 09/217,341. In addition, the above methods used to distinguish voiced speech from unvoiced speech are incorporated into the Telecommunication Industry Association Interim Standards TIA/EIA IS-127 and TIA/EIA IS-733. If the frame is determined to be unvoiced speech in step 408, the speech coder proceeds to step 410. In step 410 the speech coder encodes the frame as unvoiced speech. In one embodiment unvoiced speech frames are encoded at quarter rate, or 2.6 kbps. If in step 408 the frame is not determined to be unvoiced speech, the speech coder proceeds to step 412.

In step 412 the speech coder determines whether the frame is transitional speech, using periodicity detection methods that are known in the art, as described in, e.g., the aforementioned U.S. Pat. No. 5,911,128. If the frame is determined to be transitional speech, the speech coder proceeds to step 414. In step 414 the frame is encoded as transition speech (i.e., transition from unvoiced speech to voiced speech). In one embodiment the transition speech frame is encoded in accordance with a multipulse interpolative coding method described in U.S. Pat. No. 6,260,017, entitled MULTIPULSE INTERPOLATIVE CODING OF TRANSITION SPEECH FRAMES, filed May 7, 1999, assigned to the assignee of the present invention, and fully incorporated herein by reference. In another embodiment the transition speech frame is encoded at full rate, or 13.2 kbps.

If in step 412 the speech coder determines that the frame is not transitional speech, the speech coder proceeds to step 416. In step 416 the speech coder encodes the frame as voiced speech. In one embodiment voiced speech frames may be encoded at half rate, or 6.2 kbps. It is also possible to encode voiced speech frames at full rate, or 13.2 kbps (or full rate, 8 kbps, in an 8k CELP coder). Those skilled in the art would appreciate, however, that coding voiced frames at half rate allows the coder to save valuable bandwidth by exploiting the steady-state nature of voiced frames. Further, regardless of the rate used to encode the voiced speech, the voiced speech is advantageously coded using information from past frames, and is hence said to be coded predictively.

Figure 6A:
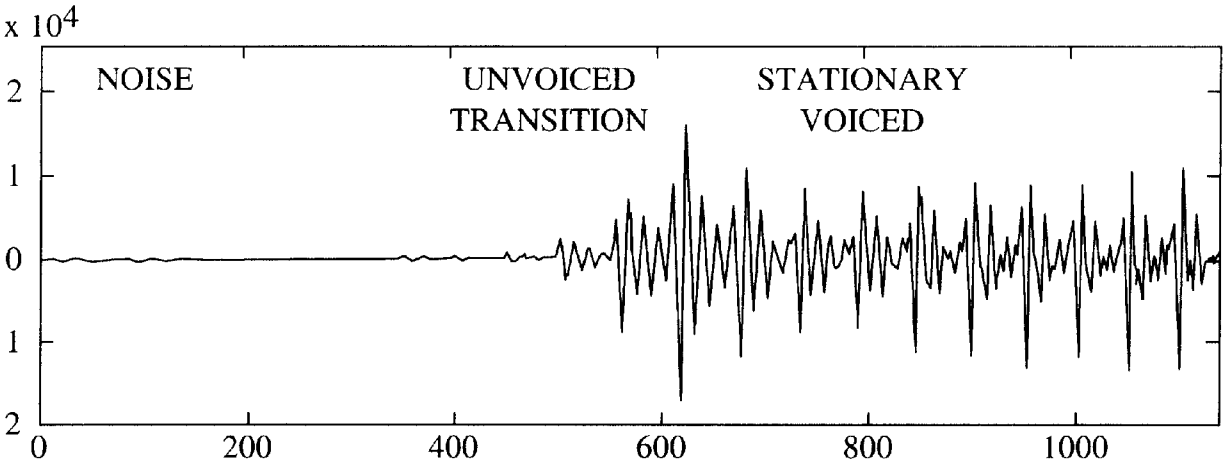
FIG. 6A is a graph speech signal amplitude versus time.
Figure 6B:
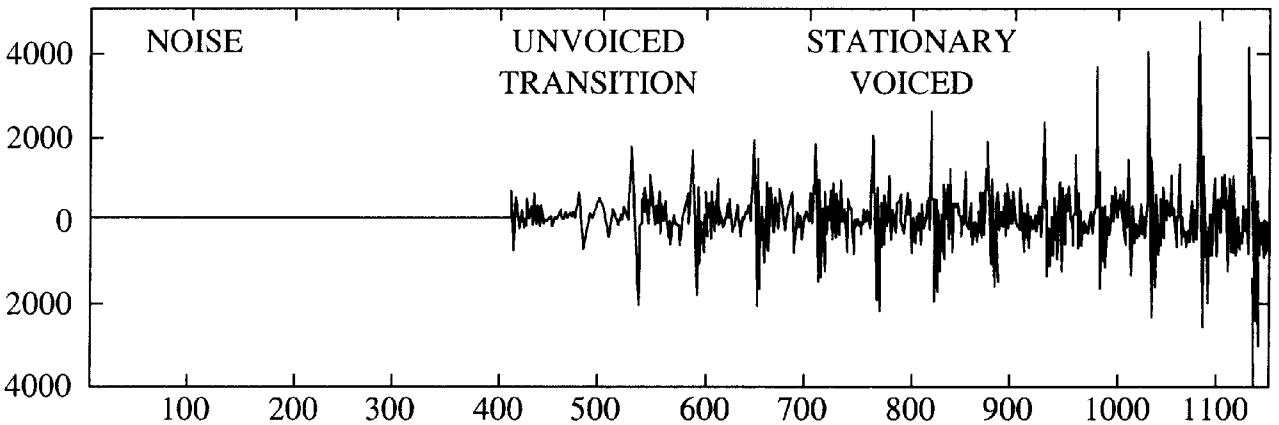
FIG. 6B is a graph of linear prediction (LP) residue amplitude versus time.

Those of skill would appreciate that either the speech signal or the corresponding LP residue may be encoded by following the steps shown in FIG. 5. The waveform characteristics of noise, unvoiced, transition, and voiced speech can be seen as a function of time in the graph of FIG. 6A. The waveform characteristics of noise, unvoiced, transition, and voiced LP residue can be seen as a function of time in the graph of FIG. 6B.

Figure 7:
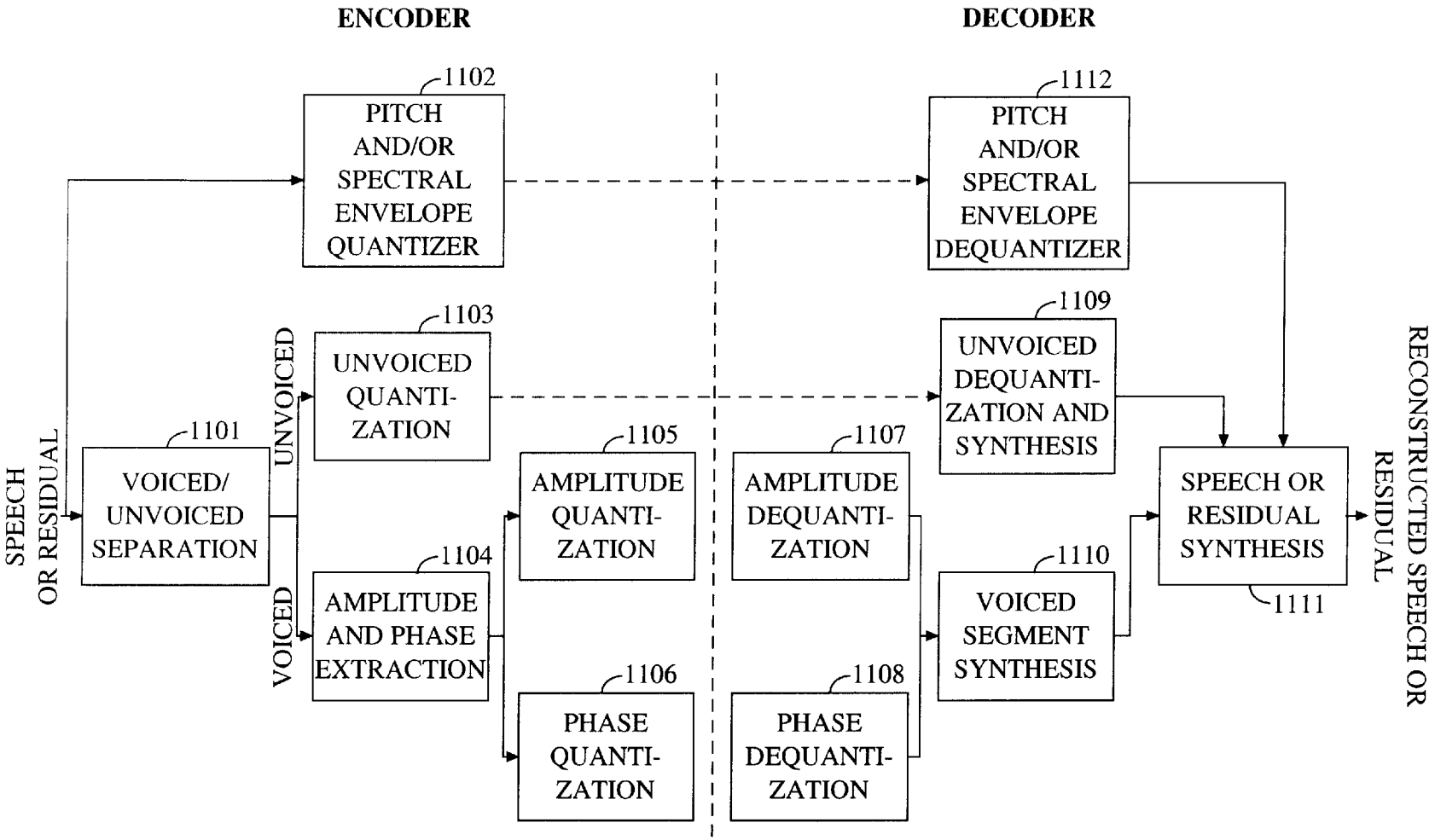
FIG. 7 is a block diagram of a speech coder having amplitude spectrum as an encoding parameter.

In one embodiment a speech coder includes a transmitting, or encoder, section and a receiving, or decoder, section, as illustrated in FIG. 7. The encoder section includes a voiced/unvoiced separation module 1101, a pitch/spectral envelope quantizer 1102, an unvoiced quantization module 1103, and amplitude and phase extraction module 1104, an amplitude quantization module 1105, and a phase quantization module 1106. The decoder section includes an amplitude de-quantization module 1107, a phase de-quantization module 1108, an unvoiced de-quantization and synthesis module 1109, a voiced segment synthesis module 1110, a speech/residual synthesis module 1111, and a pitch/spectral envelope de-quantizer 1112. The speech coder may advantageously be implemented as part of a DSP, and may reside in, e.g., a subscriber unit or base station in a PCS or cellular telephone system, or in a subscriber unit or gateway in a satellite system.

In the speech coder of FIG. 7, a speech signal or an LP residual signal is provided to the input of the voiced/unvoiced separation module 1101, which is advantageously a conventional voiced/unvoiced classifier. Such a classifier is advantageous as the human perception of voiced and unvoiced speech differs substantially. In particular, much of the information embedded in the unvoiced speech is perceptually irrelevant to human ears. As a result, the amplitude spectrum of the voiced and unvoiced segments should be quantized separately to achieve maximum coding efficiency. It should be noted that while the herein-described embodiments are directed to quantization of the voiced amplitude spectrum, the features of the present invention may also be applied to quantizing unvoiced speech.

The pitch/spectral envelope quantizer 1102 computes the pitch and spectral envelope information in accordance with conventional techniques, such as the techniques described with reference to elements 204, 206, and 210 of FIG. 3, and transmits the information to the decoder. The unvoiced portion is encoded and decoded in a conventional manner in the unvoiced quantization module 1103 and the unvoiced de-quantization module 1109, respectively. On the other hand, the voiced portion is first sent to the amplitude and phase extraction module 1104 for amplitude and phase extraction. Such an extraction procedure can be accomplished in a number of conventional ways known to those skilled in the art. For example, one particular method of amplitude and phase extraction is prototype waveform interpolation, as described in U.S. Pat. No. 5,884,253. In this particular method, the amplitude and the phase in each frame are extracted from a prototype waveform having a length of a pitch period. Other methods such as those used in the multi-band excitation coder (MBE) and the harmonic speech coder may also be employed by the amplitude and phase extraction module 1104. The voiced segment analysis module 1110 advantageously executes the inverse operations of the amplitude and phase extraction module 1104.

The phase quantization module 1106 and the phase de-quantization module 1108 may advantageously be implemented in conventional fashion. The following description with reference to FIGS. 8–10 serves to describe in greater detail the amplitude quantization module 1105 and the amplitude de-quantization module 1107.

I. Energy Normalization

Figure 8:
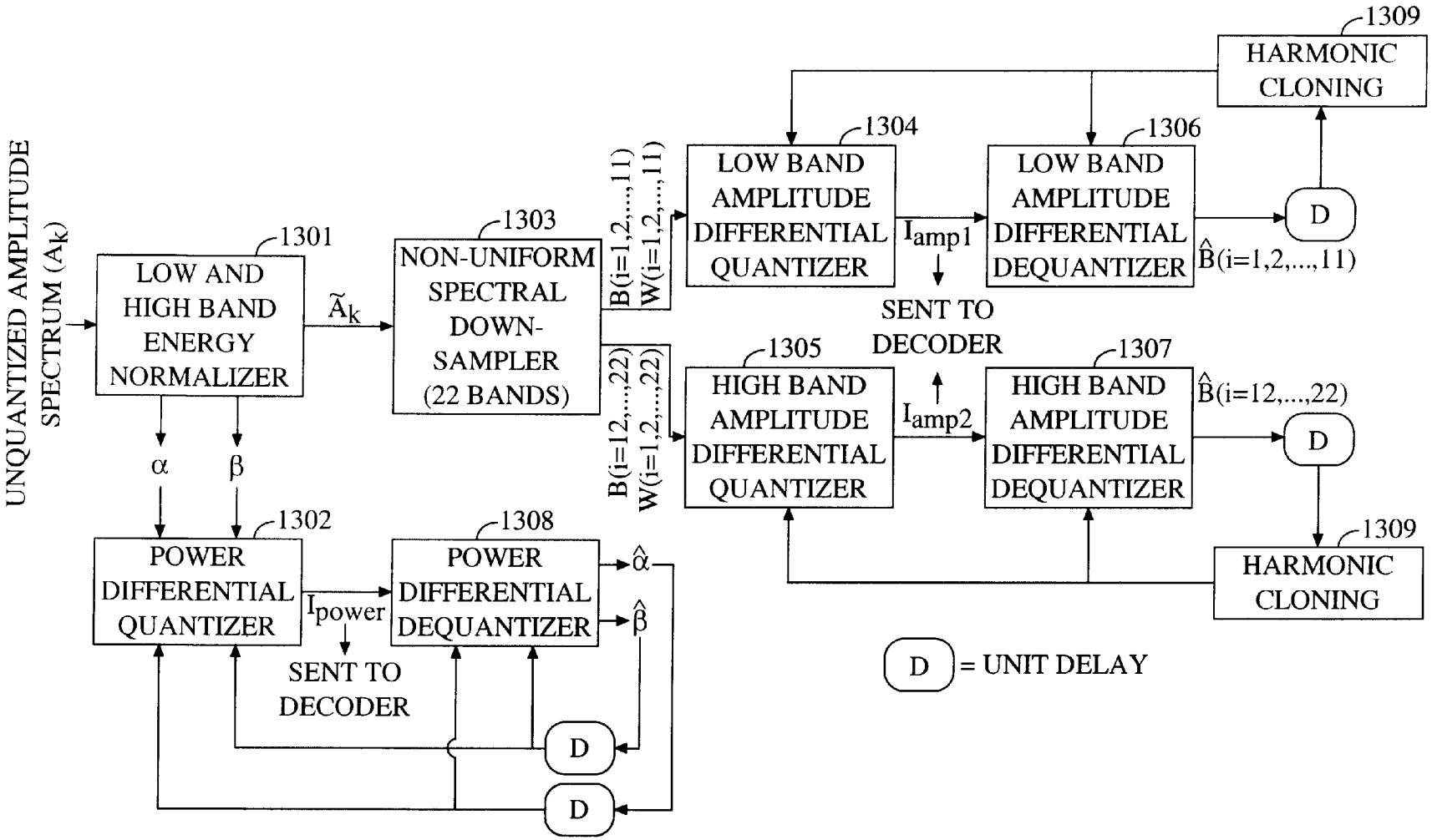
FIG. 8 is a block diagram of an amplitude quantization module that may be used in the speech coder of FIG. 7.
Figure 9:
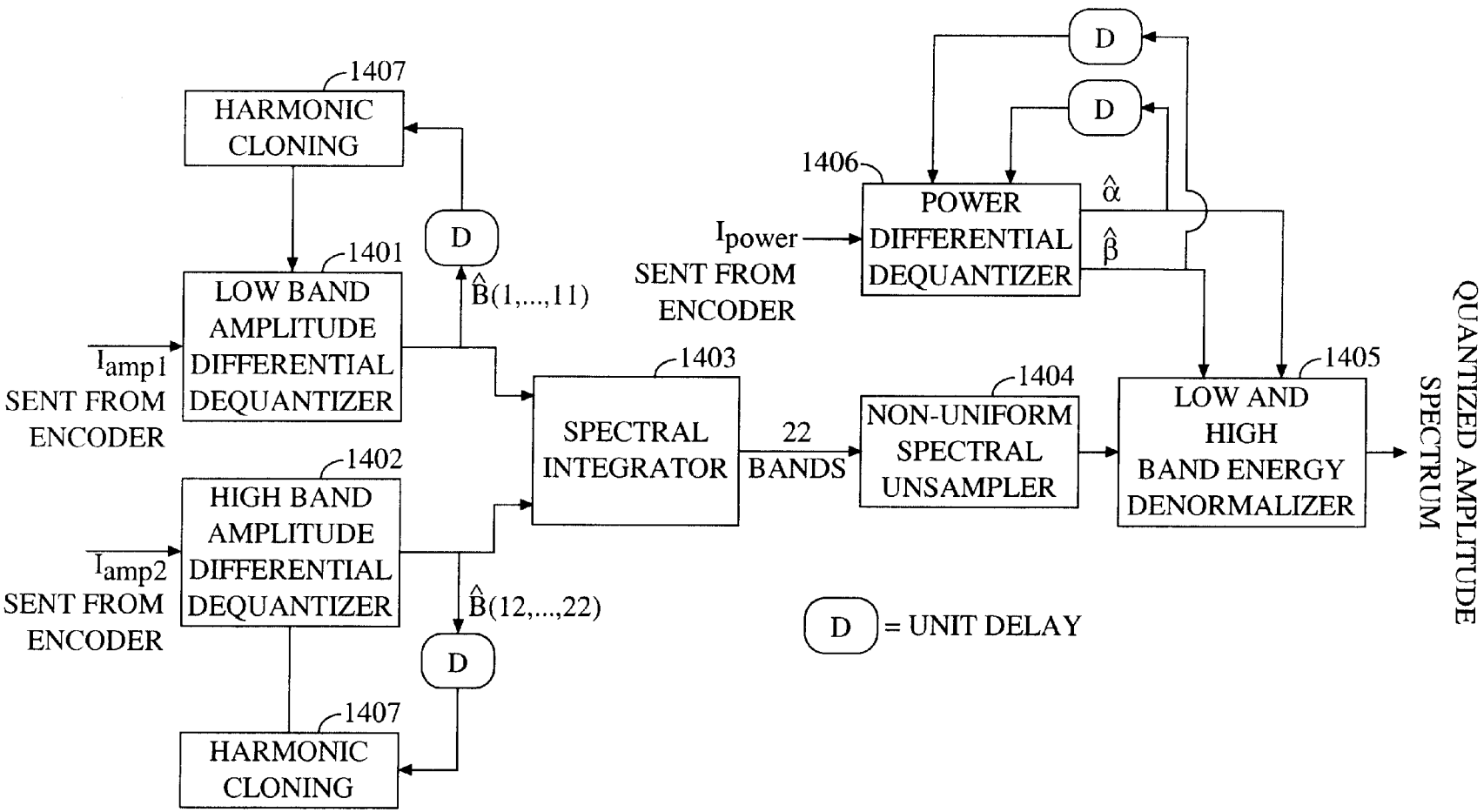
FIG. 9 is a block diagram of an amplitude de-quantization module that may be used in the speech coder of FIG. 7.

As shown in FIG. 8, an amplitude quantization module in accordance with one embodiment includes band energy normalizer 1301, a power differential quantizer 1302, a non-uniform spectral downsampler 1303, a low band amplitude differential quantizer 1304, a high band amplitude differential quantizer 1305, a low band amplitude differential de-quantizer 1306, a high band amplitude differential de-quantizer 1307, a power differential de-quantizer 1308, and a harmonic cloning module 1309 (shown twice for the purpose of clarity in the drawing). Four unit delay elements are also included in the amplitude quantization module. As shown in FIG. 9, an amplitude de-quantization module in accordance with one embodiment includes a low band amplitude differential de-quantizer 1401, a high band amplitude differential de-quantizer 1402, a spectral integrator 1403, a non-uniform spectral upsampler 1404, a band energy de-normalizer 1405, a power differential de-quantizer 1406, and a harmonic cloning module 1407 (shown twice for the purpose of clarity in the drawing). Four unit delay elements are also included in the amplitude de-quantization module.

The first step in the amplitude quantization process is determining the gain normalization factors operated in the band energy normalizer 1301. Typically, the shape of the amplitude spectra can be coded more efficiently in the low band amplitude differential quantizer 1304 and the high band amplitude differential quantizer 1305 if the amplitude spectra are first normalized. In the band energy normalizer 1301, the energy normalization is performed separately in the low band and in the high band. The relationship between an unnormalized spectrum (denoted $\{A_k\}$) and a normalized spectrum (denoted $\{\tilde{A}_k\}$) is expressed in terms of two gain factors, $\alpha$ and $\beta$. Specifically, $$\alpha = \frac{1.0}{\sqrt{\sum_{K_1} A_k^2}}, \quad \beta = \frac{1.0}{\sqrt{\sum_{K_2} A_k^2}}$$

where $$\tilde{A}_k = \alpha A_k \quad \forall k \in K_1$$

$$\tilde{A}_k = \beta A_k \quad \forall k \in K_2$$

Figure 10:
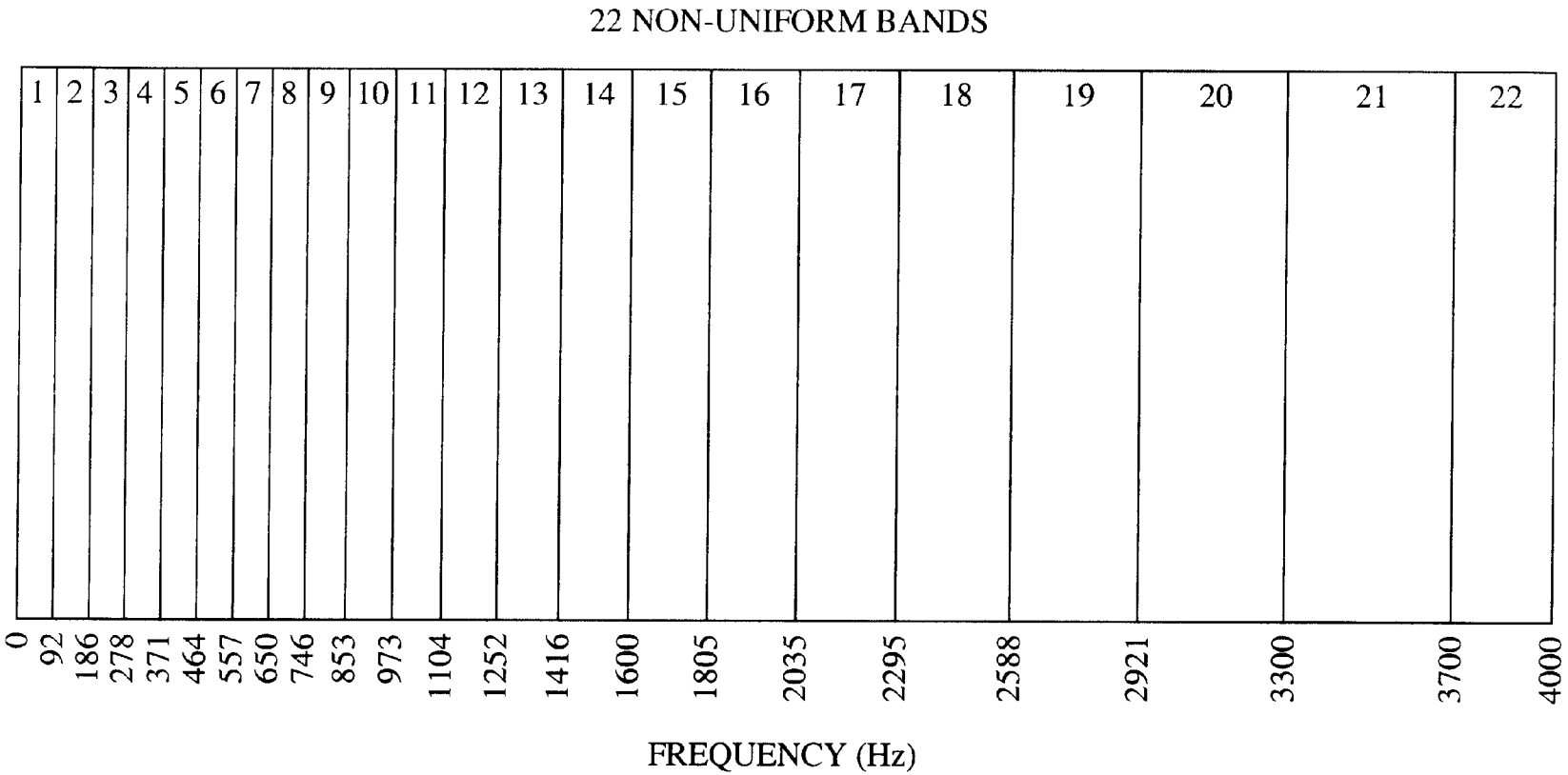
FIG. 10 illustrates a non-uniform band partition that may be performed by a spectral downsampler in the amplitude quantization module of FIG. 8, or by a spectral upsampler in the amplitude upsampler of FIG. 9.
Figures 11A, 11B, 11C:
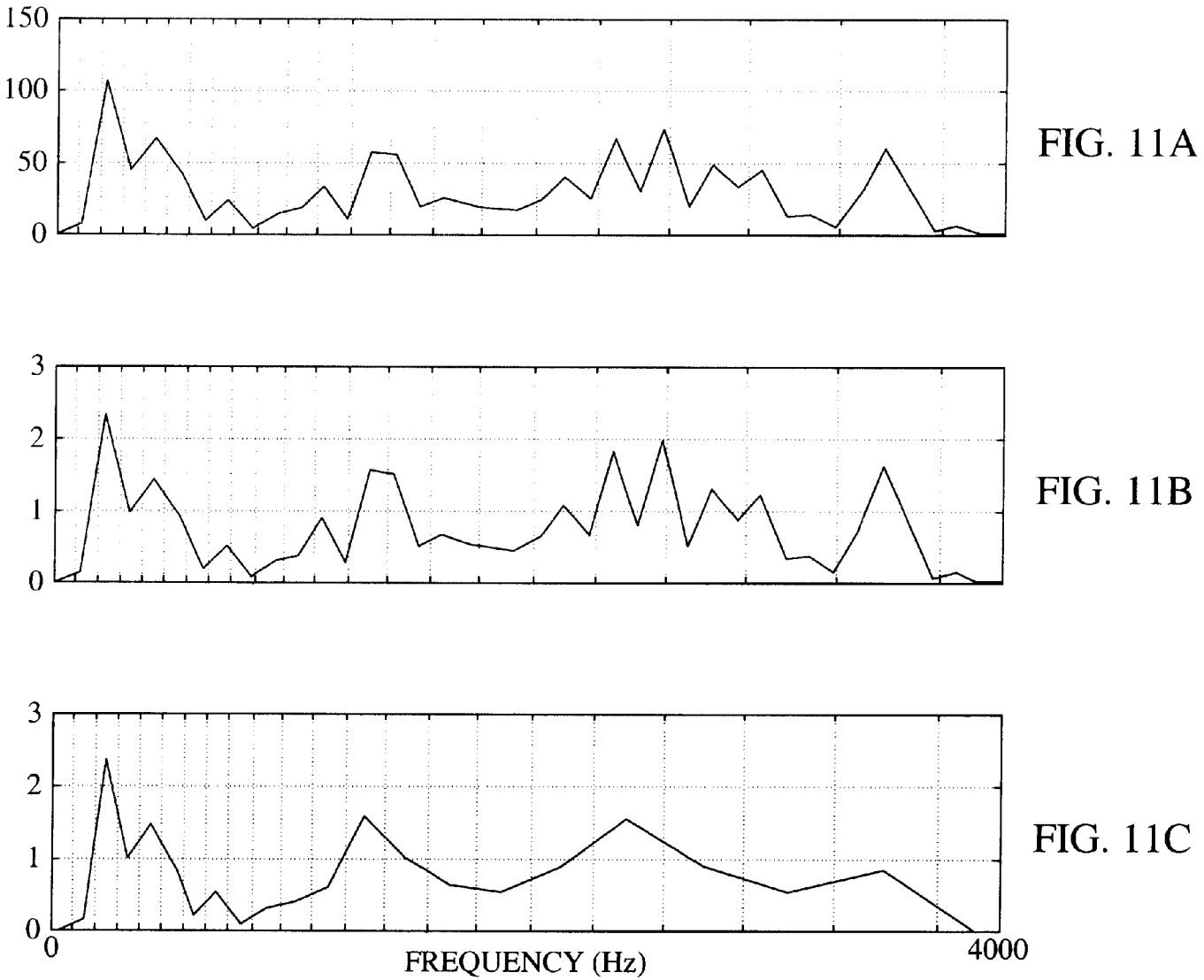
FIG. 11A is a graph of residual signal amplitude spectrum versus frequency wherein the frequency axis is partitioned according to the partitioning of FIG. 9.
FIG. 11B is a graph of the energy-normalized spectrum of FIG. 11A.
FIG. 11C is a graph of the non-uniformly downsampled and linearly upsampled spectrum of FIG. 11B.

$K_1$ represents a set of harmonic numbers corresponding to the low band, and $K_2$ represents a set of harmonic numbers corresponding to the high band. The boundary separating the low band and the high band is advantageously chosen to be at 1104 Hz in the illustrative embodiment. (As described hereinbelow, this particular frequency point actually corresponds to the right edge of band #11, as shown in FIG. 10.) The graph of FIG. 11B shows an example of the normalized amplitude spectrum. The original amplitude spectrum is shown in the graph of FIG. 11A.

II. Non-uniform Spectral Downsampling

The normalized spectrum $\{\tilde{A}_k\}$ generated by the band energy normalizer 1301 is provided to the non-uniform spectral downsampler 1303, whose operation is based upon a set of predetermined, non-uniform bands, as illustrated in FIG. 10. There are advantageously twenty-two non-uniform bands (also known as frequency bins) in the entire frequency range, and the bin edges correspond to fixed points on the frequency scale (Hz). It should be noted that the size of the first eight bands is advantageously fixed at about ninety-five Hz, whereas the sizes of the remaining bands increase logarithmically with frequency. It should be understood that the number of bands and the band sizes need not be restricted to the embodiments herein described and may be altered without departing from the underlying principles of the present invention.

The downsampling process works as follows. Each harmonic $\tilde{A}_k$ is first associated with a frequency bin. Then, an average magnitude of the harmonics in each bin is computed. The resulting spectrum becomes a vector of twenty-two spectral values, denoted B(i), i=1, 2, . . . , 22. It should be noted that some bins may be empty, particularly for small lag values. The number of harmonics in a spectrum depends on the fundamental frequency. The smallest allowable pitch value in typical speech coding systems is advantageously set to twenty (assuming a sampling frequency of eight kHz), which corresponds to only eleven harmonics. Hence, empty bins are inevitable.

To facilitate the codebook design and search in the presence of empty bins, a parameter called bin weight, W(i), i=1, 2, . . . , 22, is designated to keep track of the locations of the empty bins. The parameter W(i) is advantageously set to zero for empty bins and to unity for occupied bins. This bin weight information can be used in conventional VQ routines so as to discard empty bins during codebook searching and training. It should be noted that {W(i)} is a function of only the fundamental frequency. Therefore, no bin weight information needs to be transmitted to the decoder.

The non-uniform downsampler 1303 serves two important purposes. First, the amplitude vector of variable dimension is mapped into a fixed-dimension vector with the corresponding bin weights. Thus, conventional VQ techniques can be applied to quantize the downsampled vector. Second, the non-uniform-bin approach exploits the fact that a human ear has a frequency resolution that is a nonlinear function of frequency scale (similar to the bark-scale). Much of the perceptually irrelevant information is discarded during the downsampling process to enhance coding efficiency.

III. Quantization of Gain Factors

As is well known in the art, the logarithm of the signal power is perceptually more relevant than the signal power itself. Thus, the quantization of the two gain factors, $\alpha$ and $\beta$, is performed in the logarithmic domain in a differential manner. Because of channel errors, it is advantageous to inject a small amount of leakage into the differential quantizer. Thus, $\alpha$ and $\beta$ can be quantized and de-quantized by the power differential quantizer 1302 and the power differential de-quantizer 1308, respectively, according to the following expression:

$$[\log(\hat{\alpha}_N)\ \log(\hat{\beta}_N)] = \rho[\log(\hat{\alpha}_{N-1})\ \log(\hat{\beta}_{N-1})] + Q[\log(\alpha_N) - \rho\log(\hat{\alpha}_{N-1})\ \log(\beta_N) - \rho\log(\hat{\beta}_{N-1})]$$

where N−1 and N denote the times of two successive extracted gain factors, and Q(·) represents the differential quantization operation. The parameter $\rho$ functions as a leakage factor to prevent indefinite channel-error propagation. In typical speech coding systems, the value $\rho$ ranges between 0.6 to 0.99. The equation shown above exemplifies an auto-regressive (AR) process. Similarly, a moving-average (MA) scheme may also be appl ied to reduce sensitivity to channel errors. Unlike the AR process, the error propagation is limited by the nonrecursive decoder structure in an MA scheme.

A codebook of size sixty-four or 128 is sufficient to quantize $\alpha$ and $\beta$ with excellent quality. The resulting codebook index $I_{power}$ is transmitted to the decoder. With reference also to FIG. 9, the power differential de-quantizer 1406 at the decoder is advantageously identical to the power differential de-quantizer 1308 at the encoder, and the band energy de-normalizer 1405 at the decoder advantage ously performs the reverse operation of the band energy normalizer 1301 at the encoder.

III. Quantization of Spectral Shape

After spectral downsampling is performed by the non-uniform spectral downsampler 1301, {B(i)} is split into two sets prior to being quantized. The low band {B(i=1,2, . . . ,11)} is provided to the low band amplitude differential quantizer 1304. The high band {B(i=12, . . . ,22)} is provided to the high band amplitude differential quantizer 1305. The high band and the low band are each quantized in a differential manner. The differential vector is computed in accordance with the following equation:

$$\Delta B_N = B_N - \hat{B}_{N-1}$$

where $\hat{B}_{N-1}$ represents the quantized version of the previous vector. When there is a discrepancy between the two corresponding weight vectors (i.e., $W_N \neq W_{N-1}$, caused by a lag discrepancy between the previous and the current spectra), the resulting $\Delta B_N$ may contain erroneous values that would lower the performance of the quantizer. For example, if the previous lag $L_{prev}$ is forty-three and the current lag $L_{curr}$ is forty-four, the corresponding weight vectors computed according to the allocation scheme shown in FIG. 10 would be:

$$W_{N-1}=\{0,0,1,0,1,0,1,1,0,1, \ldots\}$$

$$W_N=\{0,1,0,1,0,1,0,1,0,1, \ldots\}$$

In this case, erroneous values would occur at i=2,4,6 in $\Delta AB_N(i)$, where the following boolean expression is true:

$$W_N(i)=1 \cap W_{N-1}(i)=0$$

It should be noted that the other kind of mismatch, $W_N(i)=0 \cap W_{N-}1(i)=1$, occurring at i=3,5,7 in this example, would not affect the quantizer performance. Because these bins have zero weights anyway (i.e., $W_N(i)=0$), these bins would be automatically ignored in the conventional weighted-search procedures.

In one embodiment a technique denoted harmonic cloning is used to handle mismatched weight vectors. The harmonic cloning technique modifies $\{\hat{B}_{N-1}\}$ to $\{\hat{B}_{N-1}\}$, such that all of the empty bins in $\{\hat{B}_{N-1}\}$ are temporarily filled by harmonics, before computing ABN. The harmonics are cloned from the right-sided neighbors if $L_{prev}<L_{curr}$ The harmonics are cloned from the left-sided neighbors if $L_{prev}>L_{curr}$. The harmonic cloning process is illustrated by the following example. Suppose $\{\hat{B}_{N-1}\}$ has spectral values W, X, Y, Z, . . . for the first four non-empty bins. Using the same example as above ($L_{prev}$=43 and $L_{curr}$=44), $\{\hat{B}_{N-1}'\}$ can be computed by cloning from the right-sided neighbors (because $L_{prev}<L_{curr}$):
clone from the right

| | |
|---|---|
| $\hat{B}_{N-}$ = | {0, 0, W, 0, X, 0, Y, 0, Z, . . . } |
| $\hat{B}'_{N-1}$ = | {W, W, W, X, X, Y, Y, Z, Z, . . . } |

where 0 means an empty bin.

If the vector $B_N$ is $$B_N=\{0, A, 0, B, 0, C, 0, D, 0, \ldots\}$$

then, $$\Delta B_N=\{(0, A\text{-}W, 0, B\text{-}X, 0, C\text{-}Y, 0, D\text{-}Z, 0, \ldots\}$$

Harmonic cloning is implemented at both the encoder and the decoder, specifically in the harmonic cloning modules 1309, 1407. In similar fashion to the case of the gain quantizer 1302, a leakage factor ρ can be applied to the spectral quantization to prevent indefinite error propagation in the presence of channel errors. For example, $\Delta B_N$ can be attained by $$\Delta B_N=B_N-\rho\hat{B}_{N-1}$$

Also, to obtain better performance, the low band amplitude differential quantizer 1304 and the high band amplitude differential quantizer 1305 may employ spectral weighting in computing the error criterion in a manner similar to that conventionally used to quantize the residual signal in a CELP coder.

The indices $I_{amp1}$ and $I_{amp2}$ are the low-band and high-band codebook indices that are transmitted to the decoder. In a particular embodiment, both amplitude differential quantizers 1304, 1305 require a total of approximately twelve bits (600 bps) to achieve toll-quality output.

At the decoder, the non-uniform spectral upsampler 1401 upsamples the twenty-two spectral values to their original dimensions (the number of elements in the vector changes to twenty-two on downsampling, and returns to the original number on upsampling). Without significantly increasing the computational complexity, such upsampling can be executed by conventional linear interpolation techniques. The graphs of FIGS. 11A–C exemplify an upsampled spectrum. It should be noted that the low band amplitude differential de-quantizer 1401 and the high band amplitude differential de-quantizer 1402 at the decoder are advantageously identical to their respective counterparts at the encoder, the low band amplitude differential de-quantizer 1306 and the high band amplitude differential de-quantizer 1307.

The embodiments described hereinabove develop a novel amplitude quantization technique that takes full advantage of the nonlinear frequency resolution of human ears, and at the same time alleviates the use of variable-dimension VQ. A coding technique embodying features of the instant invention has been successfully applied to a PWI speech coding system, requiring as few as eighteen bits/frame (900 bps) to represent the amplitude spectrum of a prototype waveform to achieve toll-quality output (with unquantized phase spectra). As those skilled in the art would readily appreciate, a quantization technique embodying features of the instant invention could be applied to any form of spectral information, and need not be restricted to amplitude spectral information. As those skilled in the art would further appreciate, the principles of the present invention are not restricted to PWI speech coding systems, but are also applicable to many other speech coding algorithms having amplitude spectrum as an explicit encoding parameter, such as, e.g., MBE and STC.

While a number of specific embodiments have been shown and described herein, it is to be understood that these embodiments are merely illustrative of the many possible specific arrangements that can be devised in application of the principles of the present invention. Numerous and varied other arrangements can be devised in accordance with these principles by those of ordinary skill in the art without departing from the spirit and scope of the invention. For example, a slight modification of the band edges (or the bin size) in the non-uniform band representation shown in FIG. 10 may not cause a significant difference to the resulting speech quality. Also, the partition frequency separating the low and the high band spectrum in the low band amplitude differential quantizer and the high band differential amplitude quantizer shown in FIG. 8 (which, in one embodiment, is set to 1104 Hz) can be altered without much impact to the resulting perceptual quality. Moreover, although the above-described embodiments have been directed a method for use in the coding of amplitudes in speech or residual signals, it will be obvious to those skilled in the art that the techniques of the present invention may also be applied to the coding of audio signals.

Thus, a novel amplitude quantization scheme for low-bit-rate speech coders has been described. Those of skill in the art would understand that the various illustrative logical blocks and algorithm steps described in connection with the embodiments disclosed herein may be implemented or performed with a digital signal processor (DSP), an application specific integrated circuit (ASIC), discrete gate or transistor logic, discrete hardware components such as, e.g., registers and FIFO, a processor executing a set of firmware instructions, or any conventional programmable software module and a processor. The processor may advantageously be a microprocessor, but in the alternative, the processor may be any conventional processor, controller, microcontroller, or state machine. The software module could reside in RAM memory, flash memory, registers, or any other form of writable storage medium known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination thereof.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A method of quantizing spectral information in a speech coder, comprising the steps of:

extracting a vector of spectral information from a frame, the vector having a vector energy value;

normalizing the vector energy value to generate a plurality of gain factors;

differentially vector quantizing the plurality of gain factors;

non-uniformly downsampling the plurality of normalized gain factors to generate a fixed-dimension vector having a plurality of elements associated with a respective plurality of non-uniform frequency bands;

splitting the fixed-dimension vector into a plurality of sub-vectors; and differentially quantizing the plurality of sub-vectors.

2. The method of claim 1, further comprising the step of forming a frequency-band-weight vector to track locations of elements corresponding to empty frequency bands.

3. The method of claim 1, wherein the extracting step comprises extracting a vector of amplitude spectrum information.

4. The method of claim 1, wherein the frame is a speech frame.

5. The method of claim 1, wherein the frame is a linear prediction residue frame.

6. The method of claim 1, wherein the normalizing step comprises normalizing the vector energy value using a two of sub-bands to generate two gain factors.

7. The method of claim 1, wherein the differentially vector quantizing step is performed in the logarithmic domain.

8. The method of claim 1, wherein the differentially vector quantizing step further comprises the step of minimizing leakage during quantization to prevent indefinite propagation of channel errors.

9. The method of claim 1, wherein the plurality of non-uniform frequency bands comprises twenty-two non-uniform frequency bands.

10. The method of claim 1, wherein the non-uniformly downsampling step comprises the steps of associating a plurality of harmonics with the plurality of non-uniform frequency bands, and computing an average magnitude of the harmonics in each frequency band, and wherein the elements of the fixed-dimension vector are the averaged harmonic magnitude values for each frequency band.

11. The method of claim 1, wherein the differentially quantizing step comprises harmonic cloning.

12. The method of claim 1, wherein the differentially quantizing step further comprises the step of minimizing leakage during quantization to prevent indefinite propagation of channel errors.

13. The method of claim 1, wherein the differentially quantizing step further comprises the step of computing error criteria with a spectral weighting technique.

14. The method of claim 1, further comprising the steps of decoding the plurality of gain factors to generate a plurality of decoded gain factors, decoding quantized values resulting from the differentially quantizing step to generate decoded normalized spectral information, upsampling the decoded normalized spectral information, and denormalizing the upsampled, decoded, normalized spectral information with the plurality of decoded gain factors.

15. The method of claim 1, wherein the speech coder resides in a subscriber unit of a wireless communication system.

16. A speech coder, comprising:

means for extracting a vector of spectral information from a frame, the vector having a vector energy value;

means for normalizing the vector energy value to generate a plurality of gain factors;

means for differentially vector quantizing the plurality of gain factors;

means for non-uniformly downsampling the plurality of normalized gain factors to generate a fixed-dimension vector having a plurality of elements associated with a respective plurality of non-uniform frequency bands;

means for splitting the fixed-dimension vector into a plurality of sub-vectors; and means for differentially quantizing the plurality of sub-vectors.

17. The speech coder of claim 16, further comprising means for forming a frequency-band-weight vector to track locations of elements corresponding to empty frequency bands.

18. The speech coder of claim 16, wherein the means for extracting comprises means for extracting a vector of amplitude spectrum information.

19. The speech coder of claim 16, wherein the frame is a speech frame.

20. The speech coder of claim 16, wherein the frame is a linear prediction residue frame.

21. The speech coder of claim 16, wherein the means for normalizing comprises means for normalizing the vector energy value using a two of sub-bands to generate two gain factors.

22. The speech coder of claim 16, wherein the means for differentially vector quantizing comprises means for differentially vector quantizing in the logarithmic domain.

23. The speech coder of claim 16, wherein the means for differentially vector quantizing further comprises means for minimizing leakage during quantization to prevent indefinite propagation of channel errors.

24. The speech coder of claim 16, wherein the plurality of non-uniform frequency bands comprises twenty-two non-uniform frequency bands.

25. The speech coder of claim 16, wherein the means for non-uniformly downsampling comprises means for associating a plurality of harmonics with the plurality of non-uniform frequency bands, and means for computing an average magnitude of the harmonics in each frequency band, and wherein the elements of the fixed-dimension vector are the averaged harmonic magnitude values for each frequency band.

26. The speech coder of claim 16, wherein the means for differentially quantizing comprises means for performing harmonic cloning.

27. The speech coder of claim 16, wherein the means for differentially quantizing further comprises means for minimizing leakage during quantization to prevent indefinite propagation of channel errors.

28. The speech coder of claim 16, wherein the means for differentially quantizing further comprises means for computing error criteria with a spectral weighting technique.

29. The speech coder of claim 16, further comprising means for decoding the plurality of gain factors to generate a plurality of decoded gain factors, and for decoding quantized values generated by the means for differentially quantizing to generate decoded normalized spectral information, means for upsampling the decoded normalized spectral information, and means for denormalizing the upsampled, decoded, normalized spectral information with the plurality of decoded gain factors.

30. The speech coder of claim 16, wherein the speech coder resides in a subscriber unit of a wireless communication system.

31. A speech coder, comprising:

an extraction module configured to extract a vector of spectral information from a frame, the vector having a vector energy value;

a normalization module coupled to the extraction module and configured to normalize the vector energy value to generate a plurality of gain factors;

a differential vector quantization module coupled to the normalization module and configured to differentially vector quantize the plurality of gain factors;

a downsampler coupled to the normalization module and configured to non-uniformly downsample the plurality of normalized gain factors to generate a fixed-dimension vector having a plurality of elements associated with a respective plurality of non-uniform frequency bands;

a splitting mechanism for splitting the fixed-dimension vector into a high-band sub-vector and a low-band sub-vector; and a differential quantization module coupled to the splitting mechanism and configured to differentially quantize the high-band sub-vector and the low-band sub-vector.

32. The speech coder of claim 31, further comprising a module for forming a frequency-band-weight vector to track locations of elements corresponding to empty frequency bands.

33. The speech coder of claim 31, wherein the extraction module is configured to extract a vector of amplitude spectrum information.

34. The speech coder of claim 31, wherein the frame is a speech frame.

35. The speech coder of claim 31, wherein the frame is a linear prediction residue frame.

36. The speech coder of claim 31, wherein the normalization module is configured to normalize the vector energy value using a two of sub-bands to generate two gain factors.

37. The speech coder of claim 31, wherein the differential vector quantization module is configured to differentially vector quantize in the logarithmic domain.

38. The speech coder of claim 31, wherein the differential vector quantization module is further configured to minimize leakage during quantization to prevent indefinite propagation of channel errors.

39. The speech coder of claim 31, wherein the plurality of non-uniform frequency bands comprises twenty-two non-uniform frequency bands.

40. The speech coder of claim 31, wherein the downsampler is configured to associate a plurality of harmonics with the plurality of non-uniform frequency bands and compute an average magnitude of the harmonics in each frequency band, and wherein the elements of the fixed-dimension vector are the averaged harmonic magnitude values for each frequency band.

41. The speech coder of claim 31, wherein the differential quantization module is configured to perform harmonic cloning.

42. The speech coder of claim 31, wherein the differential quantization module is further configured to minimize leakage during quantization to prevent indefinite propagation of channel errors.

43. The speech coder of claim 31, wherein the differential quantization module is further configured to compute error criteria with a spectral weighting technique.

44. The speech coder of claim 31, further comprising a decoder configured to decode the plurality of gain factors to generate a plurality of decoded gain factors, and to decode quantized values generated by differential quantization module to generate decoded normalized spectral information, an upsampler coupled to the decoder and configured to upsample the decoded normalized spectral information, and a denormalizer coupled to the upsampler and configured to denormalize the upsampled, decoded, normalized spectral information with the plurality of decoded gain factors.

45. The speech coder of claim 31, wherein the speech coder resides in a subscriber unit of a wireless communication system.

* * * * *